US005805953A

United States Patent [19]

Kikuchi et al.

[11] Patent Number: 5,805,953

[45] Date of Patent: Sep. 8, 1998

[54] METHOD AND APPARATUS FOR INDICATING TIME FOR EXCHANGING TONER RECOVERY CONTAINER OF ELECTROGRAPHIC APPARATUS

[75] Inventors: Toru Kikuchi, Hitachinaka; Shuho Yokokawa, Mito; Satoshi Aita; Isao Watanabe, both of Hitachinaka; Hidenori Takayasu, Hitachinaka, all of Japan

[73] Assignee: Hitachi, Ltd., Tokyo, Japan

[21] Appl. No.: 745,051

[22] Filed: Nov. 7, 1996

[30] Foreign Application Priority Data

Nov. 17, 1995 [JP] Japan ..... 7-299691

[51] Int. Cl.[6] ..... G03G 21/00

[52] U.S. Cl. ..... 399/43; 399/27; 399/35

[58] Field of Search ..... 399/24, 27, 35, 399/43, 258

[56] References Cited

U.S. PATENT DOCUMENTS 5,282,012 1/1994 Terada et al. ..... 399/299

5,374,977 12/1994 Shiina et al. ..... 399/27

5,606,403 2/1997 Kikuchi et al. ..... 399/27

FOREIGN PATENT DOCUMENTS 63-78185 4/1988 Japan .

3-166571 7/1991 Japan .

*Primary Examiner*—Arthur T. Grimley

*Assistant Examiner*—Quana Grainger

*Attorney, Agent, or Firm*—Antonelli, Terry, Stout, & Kraus, LLP

[57] ABSTRACT

In order to provide an indication when it is necessary to exchange toner recovery container, an electrophotographic apparatus monitors the accumulated driving time of a toner supply drive unit, and a massage indicating "exchange the toner recovery container" is displayed at the time when a toner supply switch is operated under state in which the accumulated driving time exceeds a preset value.

5 Claims, 5 Drawing Sheets

METHOD AND APPARATUS FOR INDICATING TIME FOR EXCHANGING TONER RECOVERY CONTAINER OF ELECTROGRAPHIC APPARATUS

BACKGROUND OF THE INVENTION

The present invention relates to an electrophotographic apparatus and a notifying method of exchanging a toner recovery container for the electrophotographic apparatus.

In an electrophotographic apparatus, almost all of a toner image formed on the surface of a photosensitive body is transferred onto a record member, such as a sheet of paper, in a transferring process. However, a small residual amount of toner is not transferred onto the record member and remains on the surface of the photosensitive body. Such residual toner is removed by a cleaning device and then recovered in a toner recovery container.

In an electrophotographic apparatus of this kind, if the status of toner recovery in a toner recovery container is not monitored, the cleaning efficiency of the cleaning device is degraded and, accordingly, the residual toner is not sufficiently removed, thereby affecting the quality of printing.

SUMMARY OF THE INVENTION

An object of the present invention is to provide a method and apparatus in an electrophotographic apparatus which are capable of properly indicating when it is time to exchange a toner recovery container.

The above object of the present invention can be attained by a method of indicating when it is time to exchange a toner recovery container in an electrophotographic apparatus having a toner supply driving unit for transferring toner to a toner hopper unit, a toner supply switch for performing driving/stopping operation of said toner supply driving unit and a toner recovery container for recovering residual toner removed from a surface of a photosensitive body, the method comprising steps of monitoring the accumulated period of time of driving operation of said toner supply driving unit from the time when said toner recovery container is exchanged, and indicating a need for exchanging said toner recovery container if said accumulated period of driving operation exceeds a preset value.

Further, the object of the present invention can be attained by an electrophotographic apparatus having a toner supply driving unit for transferring toner to a toner hopper unit, a toner supply switch for performing driving/stopping operation of said toner supply driving unit, and a toner recovery container for recovering residual toner removed from a surface of a photosensitive body, which apparatus comprises an accumulated driving period monitoring means for monitoring an accumulated period of time of driving operation of said toner supply driving unit from the time when said toner recovery container is exchanged, and a toner recovery container exchange notifying means for indicating a need for exchanging said toner recovery container if said accumulated period of driving operation exceeds a preset value.

According to the present invention, it is possible to reliably indicate a need to exchange the toner recovery container at a proper time. According to another characteristic of the present invention, the burden on an operator of the apparatus can be reduced, since the notification of a need to recover the toner recovery container is performed only when the operator is present near the apparatus.

DETAILED DESCRIPTION OF THE PREFERRED EMBODIMENTS

An embodiment of the present invention will be described in detail below with reference to the accompanying drawings.

Figure 1:
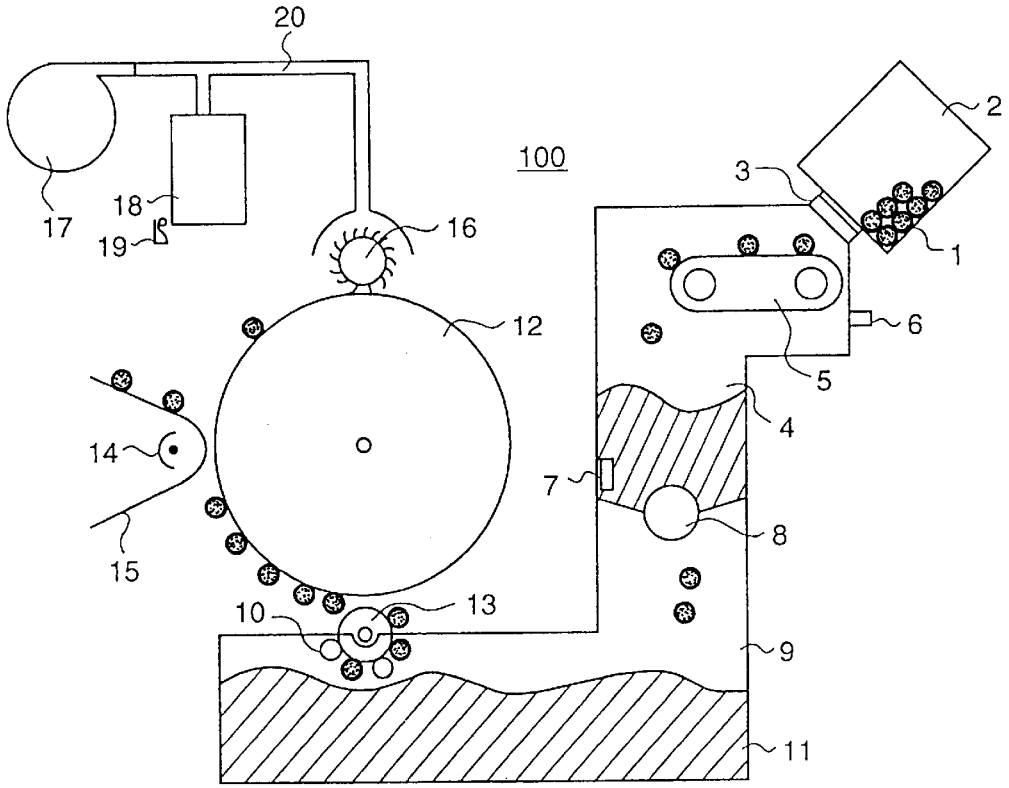
FIG. 1 is a schematic diagram showing the construction of an embodiment of an electrophotographic apparatus in accordance with the present invention.
Figure 2:
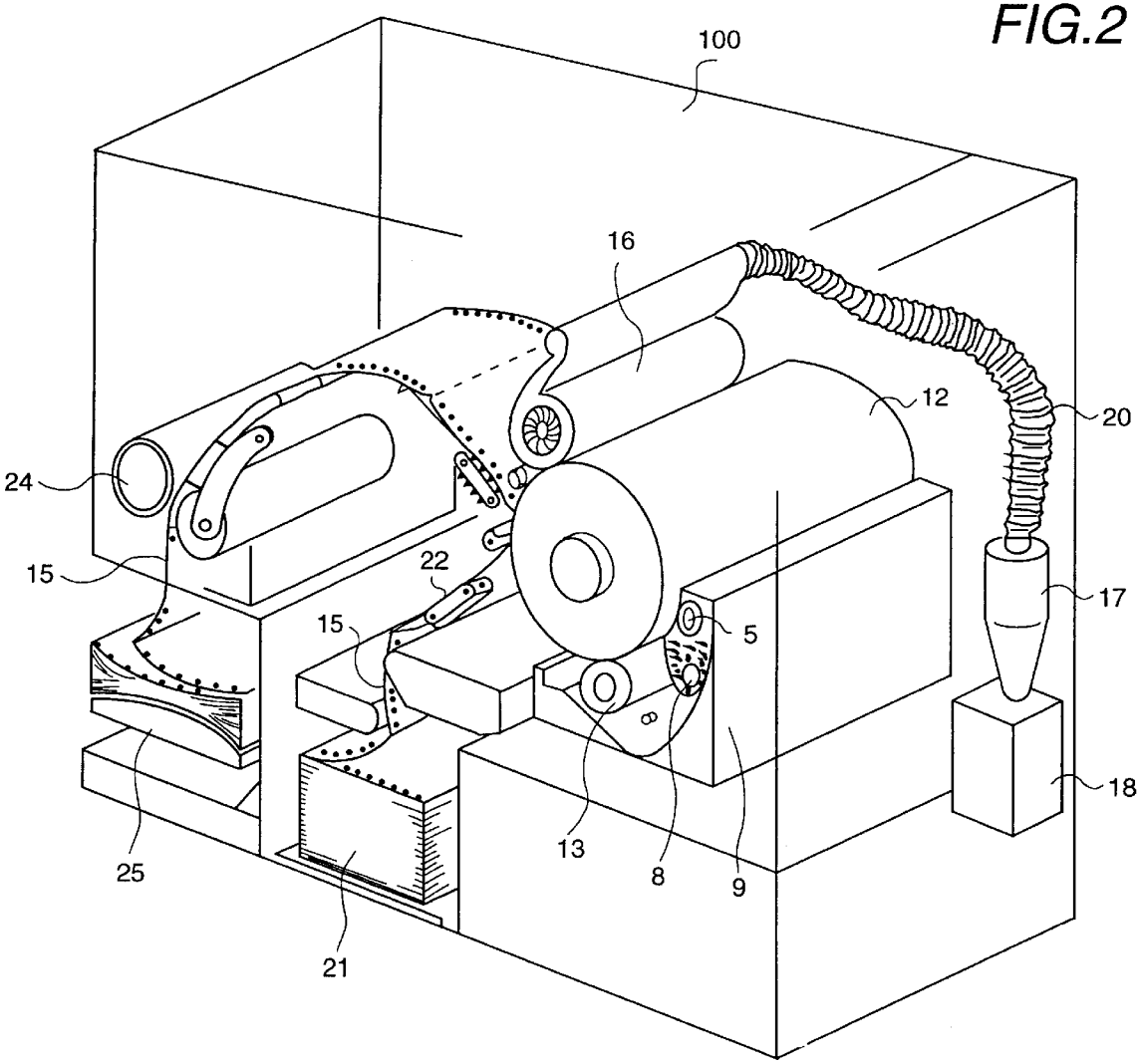
FIG. 2 is a perspective view showing the overall construction of an electrophotographic apparatus.

FIG. 1 is a schematic diagram showing the construction of an embodiment of an electrophotographic apparatus in accordance with the present invention. FIG. 2 is a perspective view showing the overall construction of an electrophotographic apparatus.

Referring to the drawings, an electrophotographic apparatus 100 has a toner hopper 4, which is a container for storing toner 1 for printing, and a toner empty sensor 7. The toner empty sensor 7 detects a lack of toner 1 in the toner hopper 4. When the toner 1 is supplied to the toner hopper 4, a toner bottle 2 filled with toner 1 is mounted onto a toner supply port 3 to transfer the toner 1 to the toner hopper 4 through the toner supply port 3 using a toner supply drive unit 5. The toner supply drive unit 5 starts to transfer toner when a toner supply switch 6 is actuated, and, after a certain time (SI) has elapsed, the motor is stopped. However, if the toner supply switch 6 is actuated again during operation of the drive unit 5, the drive unit 5 is stopped.

A toner feed driving unit 8 transfers toner 1 from the toner hopper 4 to a developer 9. Developing agent 11 is formed by mixing the toner 1 and a carrier 10 is a certain proportion for friction-charging the toner 1. The developing agent 11 is transferred to a photosensitive drum 12 by a developing roll 13 mounted on the developer 9.

Figure 3:
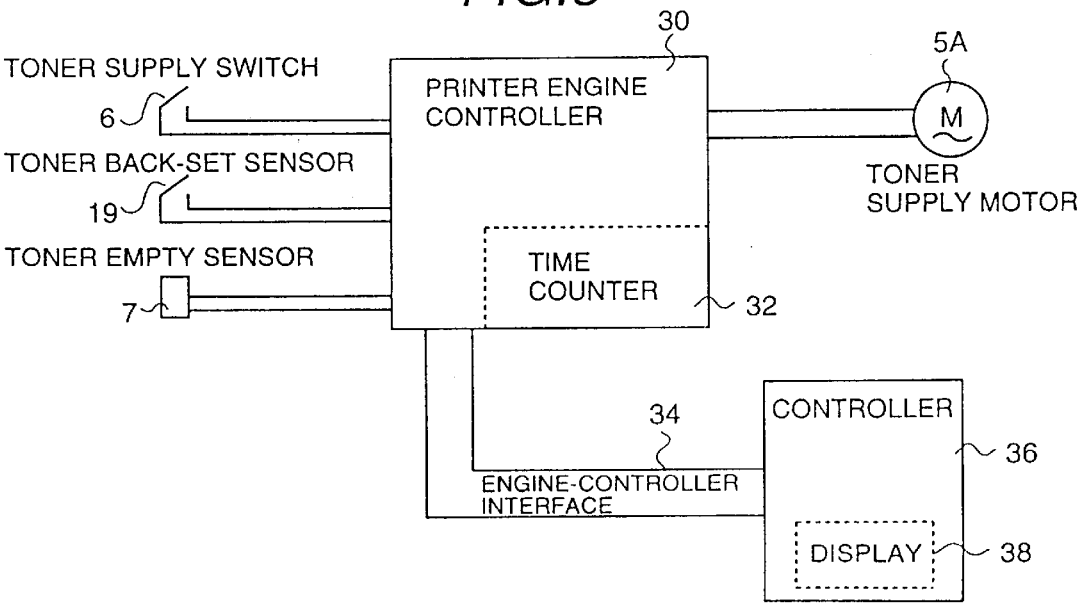
FIG. 3 is a schematic diagram showing the construction of a control system of an electrophotographic apparatus in accordance with the present invention.

The electrophotographic apparatus 100 starts to rotate the photosensitive drum 12 based on a printing operation starting signal received from a control system 22 (refer to FIG. 3). The photosensitive drum 12 is rotated with a speed corresponding to a printing speed, and continues to rotate until the printing operation is completed. As the photosensitive drum 12 is started to rotate, a voltage is applied to a corona charger to uniformly charge the surface of the photosensitive drum 12, for example, with a positive charge.

As character data and/or picture data converted into dot data is transmitted from the control system to the electrophotographic apparatus 100 as ON/OFF signals of a laser beam, portions irradiated with the laser beam and portions not irradiated with the laser beam are formed on the surface of the photosensitive drum 12. When the portions where the charge on the photosensitive drum 12 disappears due to irradiation by the laser beam arrive at a position facing the developer 9, the toner 1, which is positively charged, is attracted by static electricity to form a toner image on the photosensitive drum 12.

A sheet of paper 15 is transferred to a position between the photosensitive drum 12 and a transferring unit 14 from a paper hopper 21 by a tractor 22 in synchronism with the timing of arrival of the print data formed on the photosensitive drum 12 at the transfer position.

The toner image formed on the photosensitive drum 12 is attracted onto the paper 15 by the action of a transferring unit 14 for applying a charge having a polarity opposite to the toner image to the reverse side surface of the paper 15.

The paper 15 arriving at the transferring unit 14 is heated by a pre-heater, and nipped and transferred by a nip unit composed of a pair of fixing rolls, including a heating roll 23 and a pressing roll 24, while being heated and pressed, and thereby the toner image is melt-fixed on the paper 15. The paper 15, which is transferred by the heating roll 24 and the pressing roll 23, is transferred to a stacker table 25 where it is stacked.

Unnecessary toner remaining on the surface of drum 12 after passing through the image transferring position of the photosensitive drum 12 is scraped off by a cleaning brush 16 and is accumulated in a toner bag 18 after being sucked up with a blower 17 through a duct 20. The reference character 19 denotes a toner bag sensor which detects the time when the toner bag 18 is exchanged.

Figure 4:
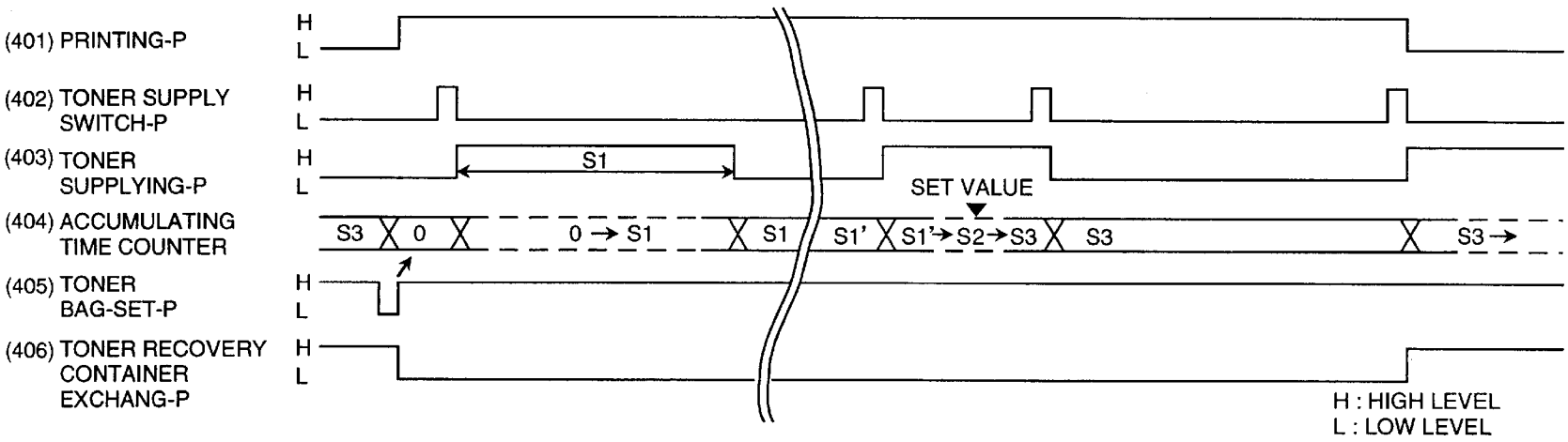
FIG. 4 is a timing chart for explaining toner supply control in accordance with the present invention.

FIG. 3 is a diagram showing the construction of a control system of an electrophotographic apparatus in accordance with the present invention. The control system is composed of a printer engine controller 30 and a controller 36. The printer engine controller 30 receives each of the outputs from the toner supply switch 6, the toner empty sensor 7 and the toner bag sensor 19. The printer engine controller has a toner supply accumulating time counter 32, which represents a means to monitor the accumulated time of use of the toner supply drive unit by measuring the periods during which a toner supply signal is at a high level. The controller 36, which is connected to the printer engine controller 30 through an interface, has a display 38. Toner supply control in the first embodiment of an electrophotographic apparatus in accordance with the present invention will be described below with reference to the timing chart of FIG. 4.

When a certain accumulated time elapses after a toner bag has been set, a massage indicating "exchange the toner bag" is displayed on the display unit 38 (406). When the toner bag 18 is exchanged in response to this display, an output (405) of the toner bag sensor 19 becomes low level (L) for a moment, and the accumulated time indicated by the time counter 32 in the printer engine controller 30 is reset to zero, so that it may restart its count (404).

The signal of the toner supply switch 6 indicates a high level (H) when the toner supply switch is actuated and a low level (L) when the toner supply switch is released. When the toner supply switch 6 is actuated to supply toner after printing is started (401), a signal (402) of the toner supply switch 6 changes from high level to low level, and a toner supply signal (403) becomes high level to start toner supply. Toner supply is automatically stopped when a certain time SI elapses. Otherwise, toner supply can be stopped by actuating the toner supply switch 6 once again.

The toner supply accumulating time counter 32 counts the time during which the toner supply signal (403) is in high level state, and monitors the accumulated time while comparing it to a preset value. When the toner supply switch is next actuated to start supplying toner after the accumulated time counter (404) reaches the preset value S2, the toner recovery container exchange signal (406) becomes high level, and a message indicating "exchange the toner recovery container" is displayed using the display unit 38.

The message indicating "exchange the toner recovery container" is not displayed immediately after the accumulated time counter (404) reaches the preset value S2, but is displayed only when the toner supply switch is actuated the next time after the accumulated time counter (404) reaches the preset value S2. The reason for this is that, at the time when the toner supply switch is actuated, an operator is always present near the apparatus. Thereby, the message is easily noticed, and the burden on the operator can be reduced.

Figure 5:
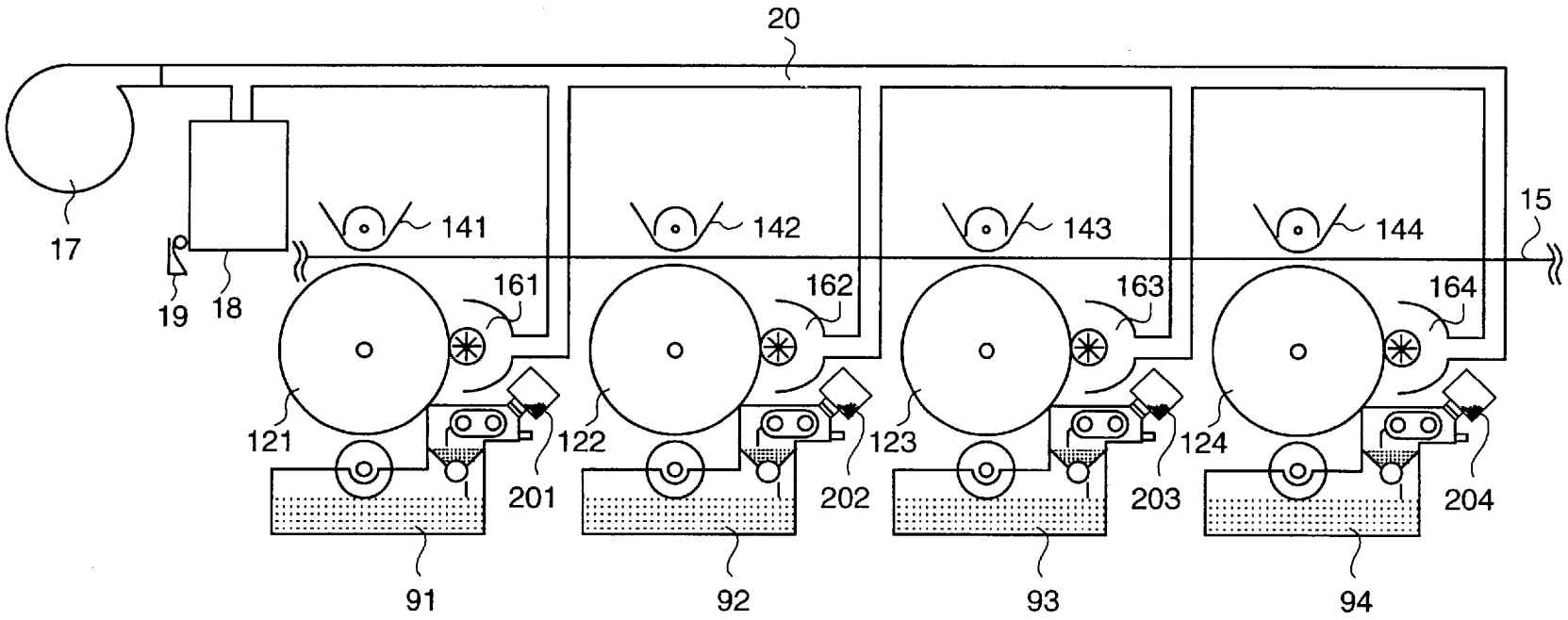
FIG. 5 is a diagrammatic view showing an embodiment of a multicolor printer to which the present invention is applied.

FIG. 5 is a view showing an embodiment of a multicolor printer to which the present invention is applied. Four photosensitive drums 121–124 each performing respective color development processes, have developers 91–94, toner bottles 201–204, heating rolls 141–144 and cleaning brushes 161–164, respectively. A blower 17, a toner bag 18 and a toner bag sensor 19 are provided in common to the four drum arrangement.

Figure 6:
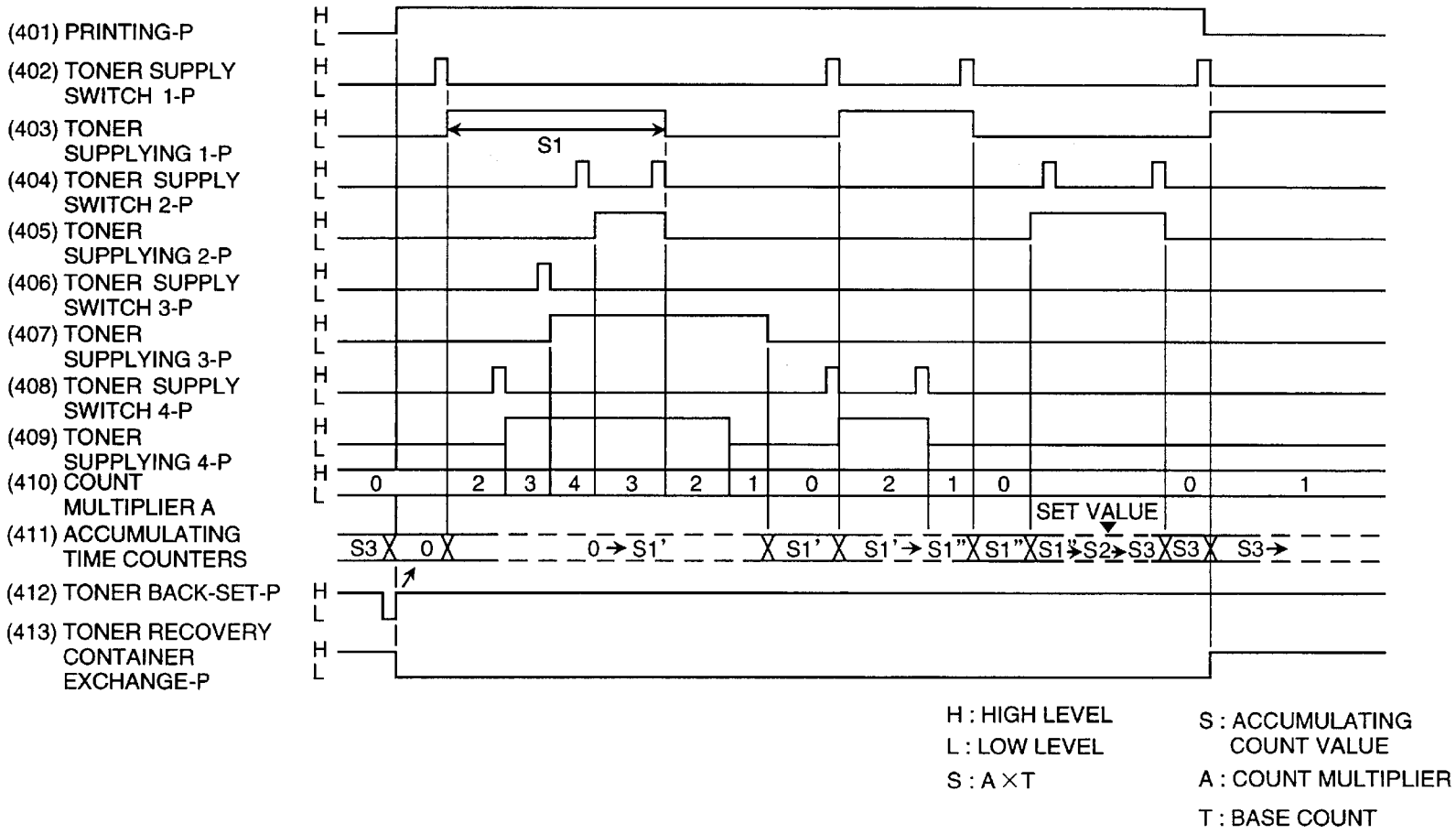
FIG. 6 is a timing chart showing operation of the multicolor printer of FIG. 5.

FIG. 6 is a timing chart showing operation of the apparatus of FIG. 5. In this embodiment, when a certain accumulated time elapses after a toner bag is set, a message indicating "exchange the toner bag" is displayed on a display unit 38 (413). When the toner bag 18 is exchanged based on this display, the output (412) of the toner bag set sensor 19 becomes low level (L) for a moment, and the accumulated time indicated by the time counter 32 in the printer engine controller is reset to zero, so that it may restart its count (411). The toner supply accumulating time counter 32 counts periods of time during which the toner supply signals (403, 405, 407, 409) corresponding to operations of the toner supply switches (402, 404, 406, 408) of the developers 91–94, respectively, are at a high level, and the accumulated time is monitored and compared with a preset value. When the toner supply switch is next actuated so as to start supplying toner after the accumulated time counter (411) reaches the preset value S2, the toner recovery container exchange signal (413) becomes high level, and the message indicating "exchange the toner recovery container" is displayed using the display unit 38.

According to the present invention, it is possible to indicate a need to exchange the toner recovery container at a proper time. Further, the burden on the operator to handle the apparatus can be reduced since the notification is performed only when the operator is present near the apparatus.

What is claimed is:

1. A method of indicating when it is time to exchange a toner recovery container in an electrophotographic apparatus having a toner supply driving unit for transferring toner to a toner hopper unit, a toner supply switch for performing driving/stopping operation of said toner supply driving unit and a toner recovery container for recovering residual toner removed from a surface of a photosensitive body, the method comprising the steps of:

monitoring an accumulated period of time of driving operation of said toner supply driving unit from a time when said toner recovery container is exchanged, and indicating a need for exchanging said toner recovery container at a time when said toner supply switch is operated after said accumulated period of time of driving operation exceeds a preset value.

2. A method of indicating when it is time to exchange a toner recovery container in a multicolor electrophotographic apparatus having a plurality of photosensitive drums, a plurality of developing units, a plurality of toner hopper units and a plurality of toner supply driving units for transferring toner to said toner hopper units corresponding to respective colors, and a toner recovery container for use in common with the plurality of photosensitive drums in said apparatus, the method comprising the steps of:

summing accumulated periods of time of driving operation of said respective toner supply driving units from the time when said toner recovery container is exchanged so as to obtain a summed value, and indicating a need for exchanging said toner recovery container at a time when any one of toner supply switches is operated after said summed value of accumulated periods of time of driving operation exceeds a preset value.

3. An electrophotographic apparatus, comprising:

a toner supply driving unit for transferring toner to a toner hopper unit, a toner supply switch for performing driving/stopping operation of said toner supply driving unit, a toner recovery container for recovering remaining toner removed from a surface of a photosensitive body, accumulated driving period monitoring means for monitoring an accumulated period of time of driving operation of said toner supply driving unit from a time when said toner recovery container is exchanged, and toner recovery container exchange indicating means for indicating a need for exchanging said toner recovery container at a time when said toner supply switch is operated after said accumulated period of time of driving operation exceeds a preset value.

4. An electrophotographic apparatus according to claim 3, wherein said accumulated driving period monitoring means comprises a toner bag sensor producing an output which changes when said toner recovery container is exchanged, and a time counter which counts time during driving operation of said toner supply driving unit and is reset to zero in response to the output of said toner bag sensor so as to restart its counting.

5. An electrophotographic apparatus according to any one of claim 3 and claim 5, wherein said apparatus is a multicolor electrophotographic apparatus having a plurality of photosensitive drums, a plurality of developing units, a plurality of toner hopper units and a plurality of toner supply driving units for transferring toner to said toner hopper units corresponding to respective colors, and wherein a single toner recovery container is provided in common to the plurality of photosensitive drums in said apparatus, wherein said accumulated driving period monitoring means sums accumulated driving periods of operation of said respective toner supply driving units from a time when said toner recovery container is exchanged so as to obtain a summed value, and said toner recovery container exchange notifying means indicates a need for exchanging said toner recovery container at a time when any one of toner supply switches is operated after said summed value of accumulated driving periods exceeds a preset value.

* * * * *

UNITED STATES PATENT AND TRADEMARK OFFICE

CERTIFICATE OF CORRECTION

PATENT NO. : 5,805,953
DATED : Sep. 8, 1998
INVENTOR(S) : KIKUCHI et al.

It is certified that error appears in the above-indentified patent and that said Letters Patent is hereby corrected as shown below:

Title page, item [73] Assignee: to read as follows:

--[73] Assignee: Hitachi Koki Co., Ltd.,
Tokyo, Japan--

Signed and Sealed this

Seventh Day of December, 1999

*Attest:*

Q. TODD DICKINSON

*Attesting Officer*

*Acting Commissioner of Patents and Trademarks*